United States Patent [19]

Gebert et al.

[11] 4,426,412

[45] Jan. 17, 1984

[54] EDGE DAM FOR PAPER COATING APPARATUS AND METHOD

[75] Inventors: Kenneth W. Gebert, Wisconsin Rapids; Pat A. Rajski, Stevens Point, both of Wis.

[73] Assignee: Consolidated Papers, Inc., Wisconsin Rapids, Wis.

[21] Appl. No.: 416,966

[22] Filed: Sep. 13, 1982

[51] Int. Cl.[3] ..... B05C 3/18

[52] U.S. Cl. ..... 427/356; 118/410; 118/413

[58] Field of Search ..... 118/407, 413, 259, 410; 427/356, 358; 101/207, 208, 210, 363, 364

[56] References Cited

U.S. PATENT DOCUMENTS

| | | | |
|---|---|---|---|
| 2,618,575 | 11/1952 | Oswin | 118/407 X |
| 3,032,007 | 5/1962 | McCauliff | 118/407 |
| 3,169,082 | 2/1965 | Krikorian | 118/415 X |
| 3,252,443 | 5/1966 | Growdon et al. | 118/407 |
| 4,327,662 | 5/1982 | Damrau | 118/410 |

*Primary Examiner*—John P. McIntosh

*Attorney, Agent, or Firm*—Gary, Juettner & Pyle

[57] ABSTRACT

An edge dam for an applicator for applying a film of coating liquid to a moving web of paper carried through an application zone, is characterized by a seal element at each side end of the zone for substantially sealing the side end of the zone, thereby to impede a flow of coating material out of the zone. At least one orifice is formed through the seal element outwardly of the zone, and the orifice is connected with a supply of water under pressure for directing a flow of water against the peripheral edge of the web moving therepast, thereby to wet the edge and flush the same of any coating material seeping past the element. In consequence, edge stickers and coating liquid pickup on the web edge are substantially eliminated.

11 Claims, 5 Drawing Figures

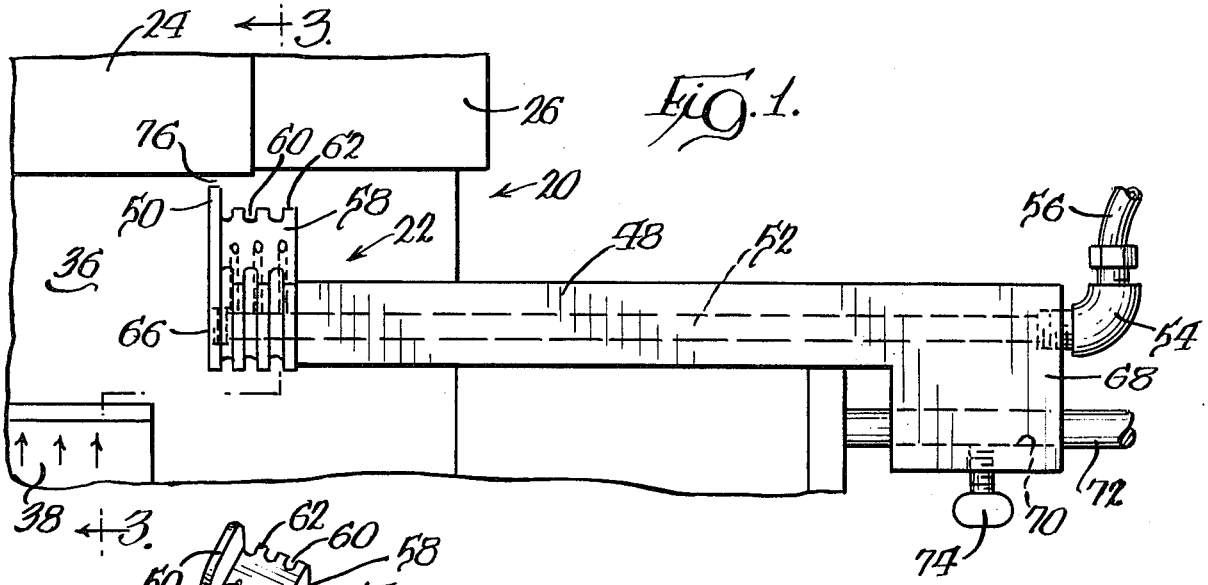
Fig. 1.
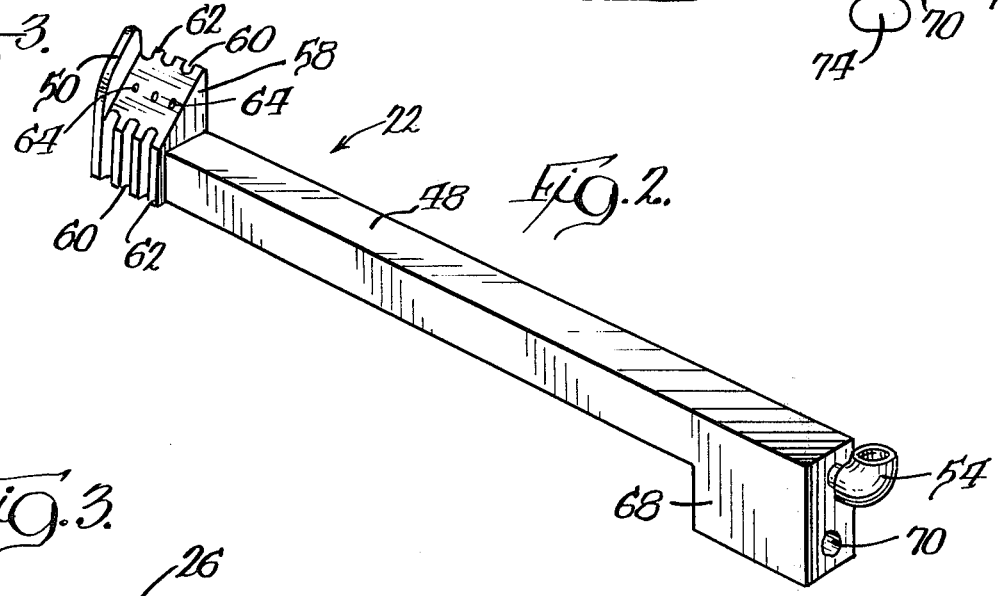
Fig. 2.
Fig. 3.
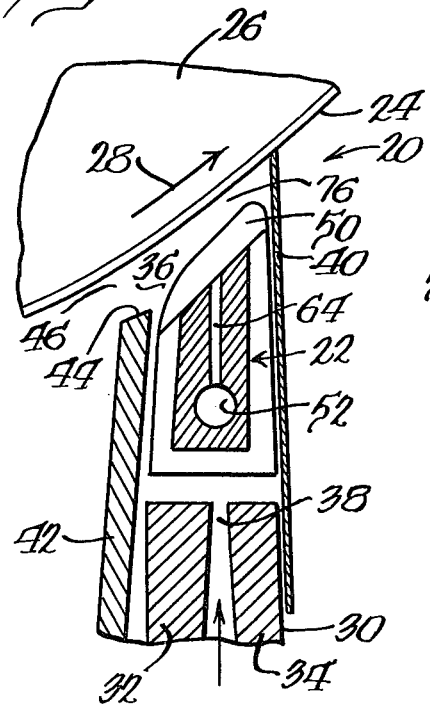
Fig. 4.
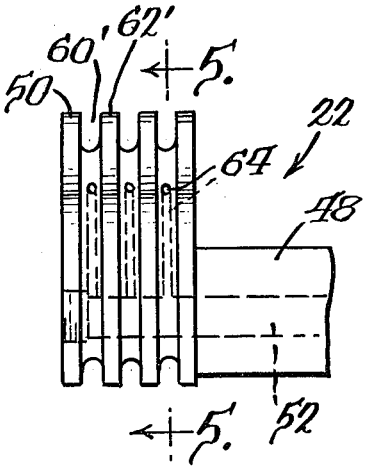
Fig. 5.
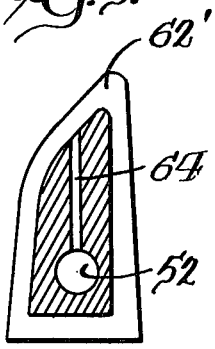

EDGE DAM FOR PAPER COATING APPARATUS AND METHOD

BACKGROUND OF THE INVENTION

The present invention relates to an improved edge dam for use with applicators of the trailing blade type for applying a coating liquid to a moving web of paper.

Conventional applicators of the trailing blade type include means for applying coating liquid to a paper web that is usually supported and carried by a backing roll. Such applicators include a chamber having an opening extending across and parallel to the web, together with a doctor blade at a trailing side of the opening for leveling the coating and a front wall or orifice plate extending from a leading side of the opening toward the web and defining an orifice for exit of excess coating material from an application zone between the wall and doctor blade. Coating liquid is supplied to the chamber and thence through the chamber opening into the application zone, and to seal end spaces between the front wall and doctor blade at side ends of the zone to prevent escape of coating material laterally of the web, edge dams are provided thereat.

For applicators of the foregoing types, the edge dam often comprises a felt, plastic or metal material configured to fill a somewhat triangular shaped opening at either end of the application zone defined by the doctor blade, orifice plate and backing roll. Ideally, the edge dam absolutely prevents leakage of any coating liquid laterally to exterior of the zone, whereby uncoated strips may be maintained along the side edges of the paper web. However, that can require that the edge dam be in contact with the web, and wear or abrasion of the edge dam or marking and tearing of the web may occur. Consequently, the edge dam is only positioned closely adjacent to, but spaced from, the web, and some coating liquid seeps therepast.

In use of edge dams, an effort is made to minimize leakage of coating liquid. However, it is usually very difficult, if not impossible, to mount edge dams at the side edges of the application zone in sufficiently close proximity to the paper web to allow only an acceptably small amount of leakage. In practice, some coating liquid leaks past the edge dam, with the result that not only do web edges become contaminated by stickers of coating liquid which bond together adjacent edges of a wound paper roll and prevent the roll from later being properly unwound, but also the coating liquid at the edges is carried by the web and deposited on rolls following or downstream from the coater station.

If leakage of coating liquid past edge dams could be eliminated, it would then be possible to coat only the center portion of a paper web, leaving narrow uncoated strips along opposite side edges of the web. This would advantageously reduce or eliminate coating material buildup on backing rolls following the coater as well as edge stickers on the coater backing roll and web. Unfortunately, conventional edge dams do not ordinarily permit the foregoing to be accomplished.

A significantly improved edge dam assembly which minimizes the above mentioned disadvantages is taught in U.S. Pat. No. 4,327,662, issued to Wayne A. Damrau on May 4, 1982 and assigned to the assignee of the present invention. As disclosed therein, an edge dam assembly is characterized by a seal element sealed with a front wall of a chamber at a forward end of an application zone and a doctor blade at a trailing end of the zone in an end space therebetween and extending toward and closely adjacent to but spaced from the web. The face of the seal element adjacent the paper web has a plurality of grooves extending generally parallel to the direction of movement of the web, so that coating material which seeps past an inner end of the seal element enters and gravitates through the grooves away from the web. In consequence, the amount of coating material leaking past the seal element and deposited on the web edge is significantly minimized. However, and while substantial improvements are obtained, it occasionally happens that coating material reaches and is deposited on the web edge.

OBJECT OF THE INVENTION

A primary object of the present invention is to provide an improved edge dam assembly for applicators for applying a coating liquid to a web of moving paper, which impdes seepage of coating liquid beyond the areas of the web to be coated and enables coating liquid pressure on the web to be maintained, while at the same time flushes from the web edge any coating liquid which is deposited on the edge.

SUMMARY OF THE INVENTION

In accordance with the present invention, an improved edge dam assembly for an applicator for applying coating liquid to a moving web of paper carried through an application zone, wherein the applicator is of the type having a body defining a chamber therein with an elongate opening to the chamber positionable generally adjacent to and transversely across the web, the chamber receiving coating liquid and directing the same through the opening and into the application zone for being applied onto the web, comprises seal means mountable at a side of the opening and zone, and means for introducing a flow of flushing fluid through the seal means and into engagement with a side edge of the web outwardly of the zone to wet the side edge and flush the same of any coating liquid which seeps past the seal means, whereby edge stickers on the web side edge are eliminated.

The invention also contemplates an improved method of applying coating liquid to a moving web of paper by applying coating liquid to one surface of the web as it is carried through an application zone having spaced front and rear edges and laterally spaced side ends, which comprises the steps of forming and maintaining a reservoir of coating liquid on the web in the zone by introducing coating liquid into a chamber having front and rear walls the upper ends of which define the front and rear edges of the zone and an opening to the zone, and flowing the coating liquid in the chamber through the opening and into the zone; doctoring the coating liquid on the web at the rear edge of the zone; and maintaining the coating liquid in the zone by substantially sealing the front and rear edges and the side ends of the zone. In this connection the improvement comprises the steps of sealing each side end of the zone by substantially closing the outermost end of the side end, and directing a flow of flushing liquid against the web outwardly of the sealed side end of the zone to wet the web and flush therefrom any coating liquid that may be deposited thereon, whereby edge stickers on the edge of the web are eliminated.

The foregoing and other objects, advantages and features of the invention will become apparent upon a consideration of the following detailed description, when taken in conjunction with the accompanying drawings.

BRIEF DESCRIPTION OF THE DRAWINGS

FIG. 1 is a longitudinal elevation view of an edge dam assembly constructed in accordance with one embodiment of the present invention, illustrating the same on an applicator for applying a coating liquid to a moving web of paper carried on a backing roll;

FIG. 2 is a perspective view of the edge dam assembly of FIG. 1;

FIG. 3 is a cross sectional side elevation view of the edge dam assembly, taken substantially along the lines 3—3 of FIG. 1;

FIG. 4 is a side elevation view of the sealing end of an edge dam assembly constructed in accordance with another embodiment of the invention, and FIG. 5 is a cross sectional side elevation view taken substantially along the lines 5—5 of FIG. 4.

DETAILED DESCRIPTION

Referring to the drawings, there is indicated generally at 20 an applicator of a type with which an edge dam or edge seal assembly, indicated generally at 22 and configured in accordance with one embodiment of the invention, is particularly adapted for use. The applicator is of the trailing blade type and applies a pigment bearing liquid coating to a moving web of paper 24 carried on a resilient backing roll 26 in a direction indicated by an arrow 28. The applicator includes a housing 30 having a coating liquid chamber defined between a front or leading wall 32 and a rear or trailing wall 34 of the housing. The walls extend generally transversely across the backing roll and taper toward an open upper end or elongate application zone 36 of the chamber. Coating liquid introduced into the chamber under pressure flows through a metering slot 38 between the front and rear walls, as shown by an arrow, into the application zone and against the web of paper. Although not shown, it is understood that opposite sides of the housing, and therefore of the metering slot, are closed by side walls extending between the front and rear walls.

During operation, the coating applicator 20 is positioned closely adjacent to the backing roll 26 with the application zone 36 facing the surface of the paper web 24. A flexible doctor blade 40 at the trailing end of the zone is clamped against the housing rear wall 34 and urged against the web by any suitable means (not shown), such for example as by a pair of transverse extending air tubes as taught in U.S. Pat. No. 4,250,211. The doctor blade serves several functions, one of which is to level and meter the coating applied to the web and another of which is to form a seal at the trailing end of the zone to prevent escape therepast of excessive amounts of coating liquid. An orifice plate 42 is mounted and vertically adjustable on the front end of the housing front wall 32, such that an upper free edge 44 of the plate extends toward but is closely spaced from the web to define therewith a narrow orifice 46 extending transversely of the web at the leading end of the zone, through which excess coating material escapes from the zone. A copious excess of coating material is supplied to the chamber and thence through the metering slot 38 into the application zone, such that material escaping from the orifice 46 forms a liquid seal in the orifice and provides, along with the edge dams 22, the orifice plate and the doctor blade, a substantially closed application zone through which the paper web passes for being coated by coating liquid under pressure.

To the extent described, the applicator is of the type disclosed in aforementioned U.S. Pat. No. 4,250,211, issued to Damrau et al and assigned to the assignee of the present invention, the teachings of which are specifically incorporated herein by reference.

To seal the spaces at the side ends of the application zone 36 between the orifice plate 42, backing roll 26 and doctor blade 40, an edge dam assembly 22 is positioned at each side end of the zone. As will be described, in improving upon conventional edge dams, the edge dam assembly of the invention substantially seals coating liquid in the application zone by means of providing a barrier to a flow of liquid out of the zone, while at the same time provides for flushing from the edge of the web any coating liquid which seeps outwardly of the zone past the barrier.

With reference to the drawings, each edge dam assembly 22 comprises a main body 48, which may be of a plastics material such as nylon or polyethelene, or any material that has good rigidity, resistance to water absorption and does not corrode. At one end of the main body is carried a somewhat triangular shaped inner seal element 50 which is configured to generally fill the opening at an end of the application zone 36 between the orifice plate 44, doctor blade 40 and backing roll 26, with the element being in sealed engagement with the orifice plate and doctor blade and close to but slightly spaced from the backing roll. A passage 52 extends longitudinally through the main body, and is provided at one end with an inlet fitting 54 which connects through a supply line 56 with a source of flushing liquid (not shown) under pressure, which preferably is a supply of water. Outwardly of the seal element 50 the body includes a quasi-triangular shaped portion 58 having a plurality of grooves 60 therein which define ridges 62 therebetween. The sides of the quasi-triangular shaped portion are shaped similar to the sides of the seal element 50, so that the portion may also be in sealed engagement with the orifice plate and doctor blade, although not necessarily closely spaced from the backing roll since the upper surface of the portion 58 does not extend as far upwardly as the upper end of the seal element 50. One or more water outlet orifices 64 in the upper surface of the portion 58 and in communication with the passage 52, and a plug 66 closes the inner end of the passage.

The generally triangular shape of the inner seal element 50 and the quasi-triangular shaped outer portion 58 enables the edge dam assembly 22 to be mounted in the space between the doctor blade 40, orifice plate 42 and backing roll 26 at a side end of the application zone 36. For the purpose, as shown in FIG. 1 a downwardly depending flange 68 of the main body 48 has a passage 70 therethrough which receives a rod 72 extending outwardly of the applicator transversely of the application zone. The flange is secured to the rod by means of a set screw 74 which enables the edge dam assembly to be conveniently removed from the applicator by being slid transversely therefrom for cleaning, repair or replacement. With the edge dam assembly mounted between the doctor blade and orifice plate, the upper end of the seal element 50 extends toward and adjacent to but spaced from the paper web and backing roll at a point spaced slightly inwardly from the side edge of the web and the upper surface of the portion 58 is below but considerably more spaced from the web outwardly of the seal element.

FIGS. 1 and 3 illustrate the mounting arrangement of the edge dam assembly 22 on the applicator. As is apparent, the configuration and size of the seal element 50 is quite important, and the element must substantially fill the area between the doctor blade, orifice plate and backing roll. If the element is too small, excessive amounts of coating liquid will seep therepast. If the element is too large, the doctor blade will be held from its doctoring position against the paper web and/or the element will engage the backing roll or web. Nevertheless, even when the element is properly sized, because of a relatively small space 76 which must be maintained between the upper end of the element and the paper web to prevent marking and tearing of the web, some coating liquid will seep past the element through the space. Ideally, the coating liquid seeping though the space will gravitate away from the side edge of the web without coating the side edge and flow through the grooves 60 in the triangular shaped portion 58. However, it often happens that some coating liquid is deposited on the edge of the web outwardly of the seal element 50, resulting in edge stickers on the web and a buildup of coating liquid on the roll 26 and any following rolls.

To overcome the aforementioned disadvantages, the edge dam assembly of the invention eliminates the problem of edge stickers on the web 24 and a buildup of coating liquid on the backing roll 26. To that end, water under pressure is introduced from the line 56 through the passage 52 in the main body 48 to the outlet orifices 64 in the portion 58. The outlet orifices open from the upper surface of the portion 58 in the upward direction, and are positioned outwardly of the seal element 50 and beneath the side edge of the web and the backing roll thereat. Consequently, water exiting the orifices is directed against the side edge of the web and the backing roll outwardly of the seal element 50 to wet the side edge and flush the edge and the backing roll of any coating liquid that seeps through the space 76 and is deposited thereon. Any coating liquid deposited on the side edge of the web and the backing roll is therefore either completely flushed away, or is at least sufficiently diluted so that the problem of edge stickers and buildup of coating liquid on the web side edge and roll are eliminated. After the water has been directed against the web and backing roll, it falls back onto the portion 58 and gravitates through the grooves 60, flushing the same of any buildup of coating liquid, so that the edge dam assembly is always maintained clean. Also, because of the significant spacing between the upper end of the portion 58 and the web, excess water readily flows out of the open outer end of the space, so that there is no substantial pressure of water to the outside of the seal element space 76 and therefore no flow of water reversely through the space into the application zone which would otherwise dilute the coating liquid therein. If desired, a small outlet orifice could be provided through the plug 66, thereby to accommodate a limited flow of water into the application zone adjacent the inner face of the seal element 50 to allow some flushing of the face, but not sufficient flushing to dilute the coating material.

As shown in the drawings, since the flow of water from the outlet orifices 64 flushes the side edge of the web and backing roll outwardly of the seal element 50, the seal element does not have to rely upon a very closely spaced relationship with the web or backing roll to form as secure a seal as possible, which can be difficult to obtain and maintain. Instead, the upper edge of the element may be spaced somewhat further from the backing roll and paper web than would be the case with conventional edge dams, thereby facilitating positioning and adjustment of the assembly on the applicator, with any excess of coating liquid escaping past the element then being flushed away by the flow of water through the orifices.

As described, the edge dam assembly 22 has a single seal element 50 closely spaced from the paper web and backing roll. However, the invention also contemplates a configuration of the generally triangular shaped portion 58 which presents a plurality of seal elements or ridges in closely spaced relationship to the web or backing roll. FIGS. 4 and 5 show such an embodiment, wherein seal elements or ridges 62' defining grooves 60' therebetween conform in peripheral shape with and extend upwardly to the same extent as does the seal element 50, and are thereby spaced the same distance from the web or backing roll as is the element 50. For this embodiment, the outlet orifices 64 exit from the centers of the grooves, thereby to direct a flow of flushing water against the web edge and backing roll for cleaning and/or diluting coating liquid thereon, which mixture of coating liquid and water then gravitates downwardly through the grooves for cleaning of the edge dam and recycling.

While embodiments of the invention have been described in detail, various modifications and other embodiments thereof may be devised by one skilled in the art without departing from the spirit and scope of the invention, as defined in the appended claims. For example, while as illustrated a water outlet orifice is provided for each groove in the edge dam assembly of FIGS. 4 and 5, more than one orifice could be provided per groove, or in the alternative orifices could be provided for every second groove, every third groove, etc.

What is claimed is:

1. An improved edge dam assembly for an applicator for applying coating liquid to a moving web of paper carried through an application zone, wherein the applicator is of the type having a body defining a chamber therein with an elongate opening to the chamber positionable generally adjacent to and transversely across the web, the chamber receiving coating liquid and directing the same through the opening into the application zone and onto the web, said edge dam assembly comprising a mechanical seal element at a side end of the opening and zone generally opposite from and extending closely adjacent to but in spaced gap relationship with the web slightly inwardly of a side edge of the web for sealing the side end of the application zone against any significant flow of coating liquid therepast; a body portion on a side of said seal element outwardly of the application zone, said body portion having a surface toward the web edge the entirety of which is spaced therefrom by an amount greater than the gap of the seal element from the web to define an enlarged space between said surface and the web edge, said space having an open outer end; and means for directing a flow of flushing liquid through said body portion surface and against the side edge of the web opposite therefrom to flush the side edge of the web free of any coating liquid which seeps past said seal element and onto the web edge, said seal element providing the seal at the application zone side end and said flushing liquid serving solely to flush from the web edge any coating liquid seeping past said seal element gap from the side edge of the web.

2. An improved edge dam assembly as in claim 1, wherein said means for directing includes at least one outlet orifice in said body portion surface outwardly of said seal element, and means for introducing flushing liquid through said orifice and against the side edge of the web.

3. An improved edge dam assembly as in claim 2, wherein said seal element and body portion are mounted at an end of an elongate member, said member has a passage therethrough in communication with said at least one orifice, and said means for introducing introduces flushing liquid into said passage, said member being mountable on the applicator to mount said edge dam assembly thereon.

4. An improved edge dam assembly as in claim 2, wherein said at least one outlet orifice comprises a plurality of outlet orifices in said body portion surface outwardly of said seal element.

5. An improved edge dam assembly as in claim 1, wherein the flushing fluid is water.

6. An improved applicator and edge dam assembly for applying coating liquid to a moving web of paper carried through an application zone, comprising a body defining a chamber therein with an elongate opening to said chamber positionable generally adjacent to and transversely across the web, said chamber receiving coating liquid therein and directing the same through said opening and into said application zone for being applied onto the web; a front wall extending from a front side of said chamber opening toward, adjacent to and substantially transversely across the web; a doctor blade extending from a rear side of said chamber opening substantially transversely across and against the web for doctoring coating liquid on the web; and edge dam assemblies at opposite ends of said front wall and doctor blade for sealing the end spaces therebetween and the side ends of said application zone, each said edge dam assembly comprising a mechanical seal element mounted between and sealed with said front wall and doctor blade and extending toward but in spaced gap relationship with the web toward and slightly inwardly of a side edge of the web for sealing the side end of the application zone against any significant flow of coating liquid therepast, a body portion on a side of said seal element outwardly of the application zone, said body portion having a surface toward the web edge the entirety of which is spaced therefrom by an amount greater than the gap of the seal element from the web to define an enlarged space between said surface and the web, said space having an open outer end; and means for directing a flow of flushing liquid through said body portion surface and against the side edge of the web opposite therefrom to flush the side edge of the web free of any coating liquid which seeps past said seal element and onto the web edge, said seal element providing the seal at the application zone side end and said flushing liquid serving solely to flush from the web edge any coating liquid seeping past said seal element.

7. An improved applicator and edge dam assembly as in claim 6, wherein said means for directing comprises at least one outlet orifice through said body portion surface outwardly of said seal element, and means for introducing flushing liquid through said at least one orifice and against the side edge of the web.

8. An improved applicator and edge dam assembly as in claim 7, wherein said seal element and body portion are mounted at an end of an elongate member, said member has a passage therethrough in communication with said at least one orifice, and said means for introducing introduces flushing liquid into said passage, said member being mounted on said applicator to mount said edge dam assembly thereon.

9. An improved applicator and edge dam assembly as in claim 8, wherein said at least one outlet orifice comprises a plurality of outlet orifices in said body portion surface.

10. An improved method of applying coating liquid to a moving web of paper by applying coating liquid to one surface of the web as it is carried through an application zone having spaced front and rear edges and laterally spaced side ends, comprising the steps of forming and maintaining a reservoir of coating liquid on the web in the zone by introducing coating liquid into a chamber having front and rear walls the upper ends of which define the front and rear edges of the zone and an opening to the zone, and flowing the coating liquid in the chamber through the opening and into the zone; and maintaining the coating liquid in the zone by substantially mechanically sealing the front and rear edges and the side ends of the zone at single points at each side end of the zone which are slightly inwardly of the side edges of the web thereat, the improvement comprising the steps of directing flows of flushing liquid against the side edges of the web outwardly of the points whereat the zone is mechanically substantially sealed to flush said web edges of any coating liquid seeping outwardly of the zone without causing a flow of flushing liquid to seep past the points of mechanical sealing and into the zone, and conveying a free flow of spent flushing liquid away from the side edges of the web.

11. An improved method as in claim 10, wherein said step of sealing said side ends of the zone comprises positioning a mechanical seal element in each side end of the zone in closely spaced relationship from and slightly inwardly of the side edge of the web thereat, and said step of directing flows of flushing liquid comprises directing flows of the liquid against the side edges of the web on the sides of the seal elements outwardly of the application zone.

* * * * *